United States Patent [19]

Stoltman

[11] 4,200,073

[45] Apr. 29, 1980

[54] ELECTRONIC THROTTLE BODY FUEL INJECTION SYSTEM

[75] Inventor: Donald D. Stoltman, Henrietta, N.Y.

[73] Assignee: General Motors Corporation, Detroit, Mich.

[21] Appl. No.: 916,755

[22] Filed: Jun. 19, 1978

[51] Int. Cl.[2] ..... F02B 3/00; F02M 39/00

[52] U.S. Cl. ..... 123/139 AW; 123/139 E; 123/32 AE

[58] Field of Search .... 123/139 E, 139 AW, 119 EC, 123/32 AE

[56] References Cited

U.S. PATENT DOCUMENTS

| | | | |
|---|---|---|---|
| 3,510,112 | 5/1970 | Winquist | 123/139 AW |
| 3,720,403 | 3/1973 | Winquist | 123/139 AW |
| 3,911,884 | 10/1975 | Moriya | 123/139 AW |
| 3,943,904 | 3/1976 | Byrne | 123/139 AW |
| 4,132,203 | 1/1979 | Elpern | 123/139 AW |

*Primary Examiner*—Ronald B. Cox
*Attorney, Agent, or Firm*—Ronald L. Phillips

[57] ABSTRACT

An electronic throttle body fuel injection system in which a fuel pump delivers fuel at constant flow and pressure to a jet in a pressure controlled chamber which is continuously ported upstream of the jet discharge to a fuel nozzle in a throttle bore and is periodically ported to bypass back to the pump fuel supply by an electrically operated on-off valve. The valve has an atmospheric reference pressure bias and is operable with a fuel demand signal from a conventional electronic fuel injection control system to open and close for time periods which vary with the fuel signal to vary the pressure in the controlled chamber between a value which induces fuel flow through the fuel nozzle for such time periods and a value which does not to thereby effect a metered flow to the fuel nozzle according to the fuel demand signal to provide the desired air/fuel ratio for optimum engine running conditions.

2 Claims, 1 Drawing Figure

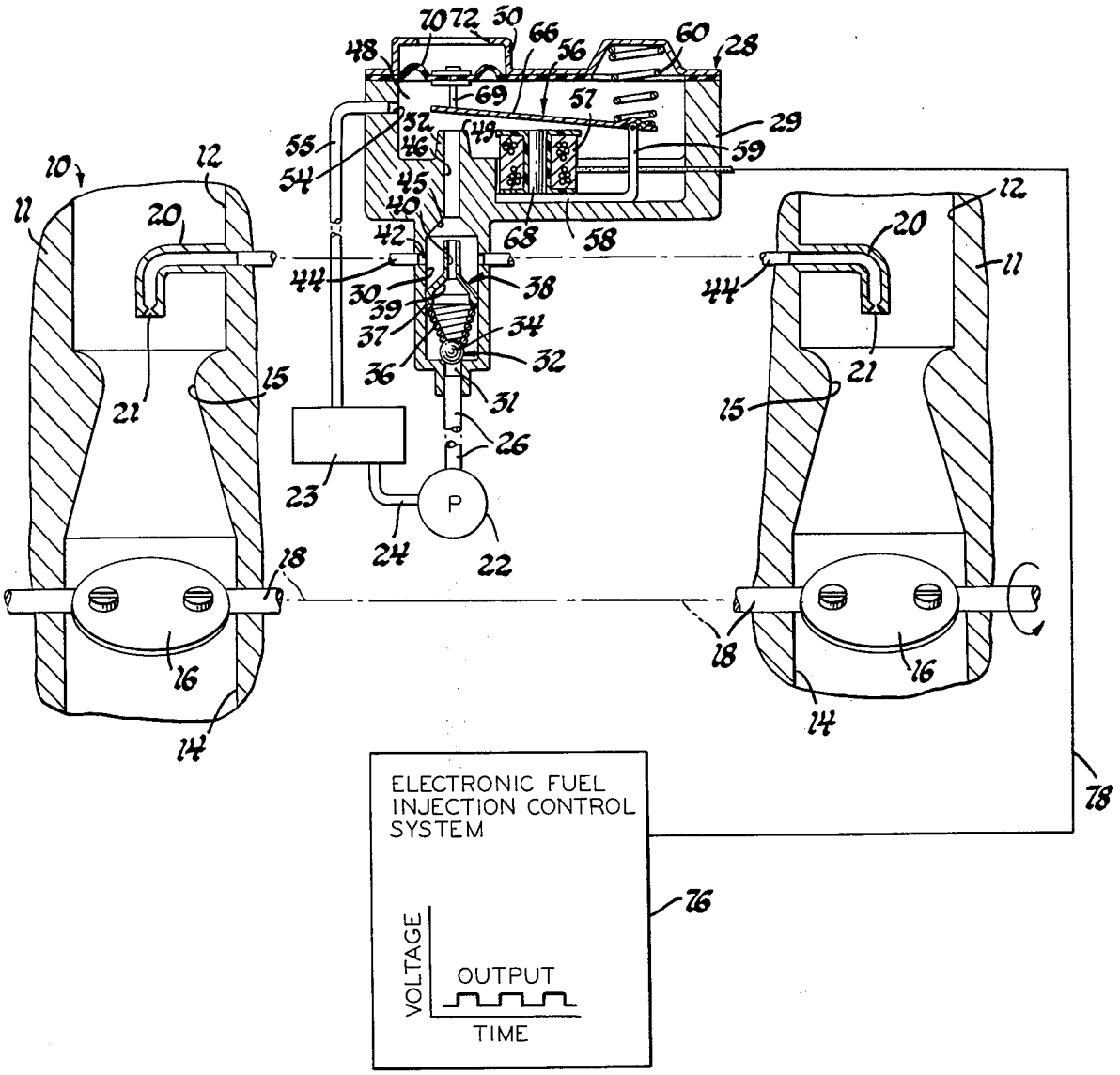
ELECTRONIC FUEL
INJECTION CONTROL
SYSTEM
VOLTAGE
OUTPUT
TIME
P

ELECTRONIC THROTTLE BODY FUEL INJECTION SYSTEM

This invention relates to electronic throttle body fuel injection systems and more particularly to the fuel metering portion of such systems.

In throttle body fuel injection systems, the fuel is injected into the one or more throttle bores of a carburetor body as distinguished from those systems where fuel is injected into the intake manifold or just upstream of the engine's intake valves. At the present state of the art, the electronic controls have improved considerably with those providing a pulse width modulated fuel demand voltage signal having proven very satisfactory in meeting various systems requirements. On the other hand, the provision of a fuel metering arrangement that will operate with such a signal with fast response and provide an output ratiometric to input without incurring complexity, bulkiness and high cost has proven difficult.

The present invention addresses such problems and advances the art by combining a constant flow and pressure fuel pump, a simple jet and ported pressure controlled chamber arrangement, and a simple electrically controlled on-off valve which is operable with a conventional pulse width modulated voltage fuel demand signal to control the pressure in the controlled chamber and thereby fuel feed to the throttle body in direct relation to the signal. Basically, the system operates by the on-off valve bypassing fuel from the controlled chamber back to the pump supply and intermittently closing such bypass for time periods according to those provided by the voltage signal to effect pressure fluctuation in the controlled chamber between a value which will induce fluid flow from the chamber through the fuel nozzle in the throttle bore and a value which will not. The valve preferably comprises a simple electromagnetically operated flapper valve element of low mass and short travel which provides fast system response so that the metered fuel flow to the fuel nozzle closely follows the fuel demand signal.

An object of the present invention is to provide a new and improved electronic throttle body fuel injection system.

Another object is to provide a new and improved electronic throttle bore fuel injection system wherein a simple, quickly responsive on-off valve operable with a conventional pulse width modulated fuel demand voltage signal is effective to establish fuel flow to the fuel nozzle proportional to the fuel signal by bypassing a portion of the fuel back to the pump.

Another object is to provide an electronic throttle body fuel injection system wherein a fuel pump supplies fuel at constant flow and pressure to a jet whose discharge is continuously open upstream thereof to a fuel nozzle in a throttle bore and is also periodically bypassed back to the pump supply by an electronically controlled on-off valve such that the fuel delivered through the fuel nozzle is proportional to the fuel signal.

Another object is to provide an electronically controlled throttle body fuel injection system wherein a fuel pump delivers fuel at constant flow and pressure through a jet into a pressure controlled chamber which is continuously ported to a fuel nozzle in a throttle bore and is periodically ported back to pump intake by an electrically operated on-off valve receiving a pulse width modulated fuel voltage signal such that the pressure in the controlled chamber is modulated to effect flow to the fuel nozzle according to the fuel signal.

These and other objects of the invention will be more apparent from the following description and drawing in which:

There is shown a diagrammatic view of an electronic throttle body fuel injection system employing a 2-barrel carburetor.

Referring to the drawing, there is shown an electronic throttle body injection system employing a 2-barrel carburetor 10 which is mountable on the intake manifold, not shown, of an internal combustion engine. The carburetor 10 includes a housing 11 having spaced apart throttle bores extending therethrough each having an inlet 12 at the upper end for receiving air, an outlet 14 at the lower end for delivering air-fuel mixture to the intake manifold, and a venturi 15 therebetween. A throttle valve 16 is arranged in each throttle bore downstream of the venturi 15 and is secured to a transversely extending throttle shaft 18 which is mounted in the housing 11 and on turning in the direction of the arrow moves both the throttle valves from a closed toward an open position. A fuel nozzle 20 having an orifice 21 at its outlet is also provided in each throttle bore and extends radially inward from the throttle bore wall and then at the center of the bore turns in the downstream direction so as to inject fuel at the throat of the venturi and toward the throttle valve.

A fuel pump 22 receives fuel from a fuel tank 23 through a line 24 and supplies the fuel at constant flow and pressure through a line 26 to a fuel metering unit 28 which meters fuel to the nozzles 20. The metering unit 28 includes a housing 29 having a cylindrical pressure controlled chamber 30 which is connected by an inlet port 31 in the housing to the fuel line 26. A check valve 32 controls the opening between the chamber 30 and the inlet port 31 and includes a ball valve 34 which is biased to close the inlet 31 by a spring 36. Spring 36 is seated on the cylindrical rim 37 of a jet 38 which is secured at the rim to the wall of the chamber. Opening of the check valve 32 upon pump operation admits fuel to a converging conical section 39 of the jet whereafter it is then directed through a constant diameter discharge passage 40 which terminates near the upper end of the chamber 30. The jet discharge passage 40 is located substantially radially inwardly of the cylindrical wall of chamber 30 and intermediate the length of the jet passage and substantially remote from the exit thereof there are provided fuel nozzle feed ports 42 which are connected by separate feed lines 44 to the respective fuel nozzles 20 in the throttle bores. The upper end of the pressure controlled chamber 30 has a converging conical section 45 which is connected by a bypass control port 46 to a regulator chamber 48 in the upper end of the housing 29, this chamber being closed by a cap 50 and the bypass control port 46 being axial aligned with the jet passage 40. A boss 52 extends the bypass ports 46 upwardly into the chamber 48 to terminate at an elevated position therein. The housing 29 further has a return port 54 which is connected by a line 55 back to the fuel tank 23 to thus return or bypass fuel thereto rather than out through the feed ports 44 to the fuel nozzles.

The bypass flow and thus the pressure in the pressure controlled chamber and fuel flow through the nozzles is controlled by an on-off valve 56 mounted in the regulator chamber 48. The valve 56 includes an electromagnet 57 which is secured by a bracket 58 to the bottom of chamber 48. The bracket 58 further serves as a fulcrum for the valve by extending rightwardly and having an arm 59 extending upward to terminate at a height corresponding to that of the bypass control port 46. A magnetic valve element 66 of the flapper valve type which may be a simple sheet metal stamping is pivotally mounted at its right hand end on the upper end of bracket arm 59 and is held in place by a spring 60 which is seated on the cap 50. The magnetic valve element 66 extends over the core 68 of the electromagnet and then over the bypass port 46 where it is pivotally secured by linkage 69 to a diaphragm 70. The diaphragm 70 provides the chamber 48 with an expansible wall portion which is exposed on the interior side to the fuel pressure and is exposed on the opposite or outer side to atmosphere through an opening 72 in the cap 50.

When voltage is applied to the electromagnet 57, the valve element 66 is attracted thereto and seats on the top 49 of the boss 52 to close the bypass control port and, alternately, when the voltage is turned off, the valve 66 is forced by the jet discharge to return to an open position as shown. When the valve is closed, the fuel pressure in the pressure controlled chamber 30 is thus caused to build toward fuel line pressure and, alternatively, when the valve is open for bypass flow the fuel pressure in the chamber is caused to decrease. According to the present invention, the system is calibrated so that during valve opening the bypass flow is effective to reduce the pressure in the chamber 30 to a value which will not induce substantial flow through the feed ports and out the fuel nozzles, i.e. the pressure differential across the feed ports and fuel nozzles is zero or close thereto, as determined by the reference pressure of the regulator which in the embodiment shown is atmospheric pressure. However this reference pressure may be some other reference pressure as will be disclosed later. Alternatively, when the valve 66 is closed, the pressure in the chamber 30 builds toward full fuel line pressure and this causes substantial flow out through the feed ports 42 and the nozzles 20 into the throttle bore, the amount of such fuel flow thus being in direct proportion to the length of time the valve is closed and opened. Thus, the above system with the on-off valve 56 is well suited to operate with a conventional electronic fuel control system designated as 76 which provides a pulse width modulated voltage fuel demand signal to a line 78. Such electronic injection control systems, as is well known, time the voltage on and off for equal and varying time periods according to engine speed, throttle position, mass flow, etc. to provide the desired air/fuel ratio control.

Describing now the system operation with a pulse width modulated voltage signal from the line 78, such voltage pulses to the electromagnet 57 cause the valve 56 to open and close the discharge from the jet 38 to the regulator chamber 48 for periods corresponding to the varying width or time of these pulses. During those time periods when the valve 56 is closed, the pressure in the pressure controlled chamber 30 is thereby caused to build to fuel line pressure and thereby induce flow through the nozzles for the duration of such varying time periods. Alternatively, when the voltage is off and the valve 56 is thus open, fuel from the pressure controlled chamber is bypassed back to the fuel tank to reduce the pressure in the chamber to atmospheric pressure whereby flow is effectively prevented through the nozzles thus resulting in a metered flow through the nozzles directly proportional to this fuel demand signal.

In the case where the voltage signal is applied at engine frequency and the pulse width is modulated by intake manifold absolute pressure, and with the mass and travel of the valve element 66 low, the system response is fast and the flow issuing from the fuel nozzles 20 is digital or pulsed and assumably stoichiometric control of the air-fuel mixture is obtained. To assure stoichiometric control, open loop backup is required and in that case speed/density control is replaced by a mass system sensing the air flow, and the throttle angle and operating at a fixed frequency compatible with the characteristics of valve 56.

Having thus described the system with a 2-barrel carburetor arrangement it will be appreciated that the metering unit 28 could be connected to meter fuel to only one throttle bore or more than two throttle bores dependent upon engine application. Furthermore, it will be appreciated that some pressure other than atmospheric pressure may be used as the regulator reference bias to provide accurate on-off fuel nozzle feed delivery control. For example, the reference pressure could be intake pressure in the throttle bore in the vicinity of the throttle nozzle exit to ensure that there is no substantial pressure differential between the pressure controlled chamber and the nozzle exit and thereby assure no fuel discharge during the off period of the regulator valve.

The above described preferred embodiments are illustrative of the invention which may be modified within the scope of the appending claims.

The embodiments of the invention in which an exclusive property or privilege is claimed are defined as follows:

1. A throttle body fuel injection system comprising a carburetor having a throttle bore, a throttle valve mounted in said throttle bore for controlling flow therethrough, a fuel nozzle mounted in said throttle bore for discharging fuel in a downstream direction and toward said throttle valve, a fuel pump for supplying fuel at constant flow and pressure, and fuel metering means supplied by said pump means for metering fuel to said fuel nozzle comprising a pressure controlled chamber, a check valve for connecting said pump to said pressure controlled chamber, a nozzle feed port open to said pressure controlled chamber and continuously connected to said fuel nozzle, a regulator chamber, a bypass port open to said pressure controlled chamber and connected to said regulator chamber, jet means downstream of said check valve for receiving the pump flow and discharging it into said pressure controlled chamber and toward said bypass control port, a return port open to said regulator chamber and connected to return fuel to said pump, regulator valve means for periodically closing said bypass port to said regulator chamber comprising a magnetic valve element movable to open and close said bypass port and an electromagnet operable on energization to close said magnetic valve element against the fluid force from the jet discharge, and air pressure responsive bias means for determining the force required to open said valve element so that when said electromagnet is periodically energized said valve operates to open and close to cause the pressure in said pressure controlled chamber to vary between a value which induces fuel flow through said fuel nozzle and a value which substantially does not.

2. A throttle body fuel injection system comprising a carburetor having a throttle bore, a throttle valve mounted in said throttle bore for controlling flow therethrough, a fuel nozzle mounted in said throttle bore for discharging fuel in a downstream direction and toward said throttle valve, a fuel pump for supplying fuel at constant flow and pressure, and fuel metering means supplied by said pump means for metering fuel to said fuel nozzle comprising a pressure controlled chamber, a check valve for connecting said pump to said pressure controlled chamber, a nozzle feed port open to said pressure controlled chamber and continuously connected to said fuel nozzle, a regulator chamber, a bypass port open to said pressure controlled chamber and connected to said regulator chamber, jet means downstream of said check valve for receiving all the pump flow and discharging it into said pressure controlled chamber at a point downstream of said nozzle feed port and toward said bypass control port, said jet means having a discharge passage aligned with said bypass port and having a flow area larger than said fuel nozzle, a return port open to said regulator chamber and connected to return fuel to said pump, regulator valve means in said regulator chamber for periodically closing said bypass port to said regulator chamber comprising a magnetic valve element movable to open and close said bypass port in the path of the jet discharge and an electromagnet operable on energization to close said magnetic valve element against the fluid force from the jet discharge, and air pressure responsive bias means for determining the force required to open said valve element so that when said electromagnet is periodically energized said valve operates to open and close to cause the pressure in said pressure controlled chamber to vary between a value which induces fuel flow through said fuel nozzle and a value which substantially does not by bypassing a portion of the fuel supplied back to said pump to thereby effect a metered fuel flow from said fuel nozzle proportional to the time periods of energization and deenergization of said electromagnet.

* * * * *